US007665240B1

(12) United States Patent
Bentley

(10) Patent No.: US 7,665,240 B1
(45) Date of Patent: Feb. 23, 2010

(54) MODULAR SYSTEM RIFLE STOCK

(75) Inventor: James K Bentley, Paso Robles, CA (US)

(73) Assignee: Blackhawk Industries Product Group Unlimited LLC, Norfolk, VA (US)

( * ) Notice: Subject to any disclaimer, the term of this patent is extended or adjusted under 35 U.S.C. 154(b) by 90 days.

(21) Appl. No.: 11/704,537

(22) Filed: Feb. 9, 2007

Related U.S. Application Data

(60) Provisional application No. 60/771,934, filed on Feb. 9, 2006.

(51) Int. Cl.
*F41A 11/02* (2006.01)

(52) U.S. Cl. ..... 42/75.03; 42/71.01; 42/72

(58) Field of Classification Search ..... 42/71.01, 42/75.03, 72
See application file for complete search history.

(56) References Cited

U.S. PATENT DOCUMENTS

| | | | | | |
|---|---|---|---|---|---|
| 2,205,891 | A * | 6/1940 | Sprenger | 156/222 |
| 2,292,351 | A * | 8/1942 | Carpenter et. al. | 42/71.01 |
| 3,011,283 | A * | 12/1961 | Lunn et al. | 42/71.01 |
| 3,023,527 | A * | 3/1962 | Leek et al. | 42/71.01 |
| 4,674,216 | A * | 6/1987 | Ruger et al. | 42/71.01 |
| 5,615,508 | A * | 4/1997 | Miller et al. | 42/71.01 |
| 5,711,102 | A * | 1/1998 | Plaster et al. | 42/71.01 |
| 5,722,195 | A * | 3/1998 | Bentley et al. | 42/74 |
| 5,974,718 | A * | 11/1999 | Bentley et al. | 42/74 |
| 6,070,354 | A * | 6/2000 | Burigana et al. | 42/71.01 |
| 6,250,194 | B1 * | 6/2001 | Brandl et al. | 89/1.41 |
| 6,256,921 | B1 * | 7/2001 | Howard et al. | 42/71.01 |
| 6,301,817 | B1 * | 10/2001 | Hogue et al. | 42/71.01 |
| 6,427,372 | B1 * | 8/2002 | Howard et al. | 42/71.01 |
| 7,162,822 | B1 * | 1/2007 | Heayn et al. | 42/73 |
| RE40,216 | E * | 4/2008 | Swan | 42/71.01 |
| 2003/0140542 | A1 * | 7/2003 | Kay | 42/75.03 |
| 2004/0031182 | A1 * | 2/2004 | Bentley | 42/74 |
| 2007/0006510 | A1 * | 1/2007 | McCormick | 42/75.02 |
| 2007/0089347 | A1 * | 4/2007 | Webber et al. | 42/75.03 |
| 2007/0101631 | A1 * | 5/2007 | Bentley | 42/74 |

* cited by examiner

*Primary Examiner*—Bret Hayes
*Assistant Examiner*—Michael D David
(74) *Attorney, Agent, or Firm*—Bowman Green Hampton & Kelly, PLLC

(57) ABSTRACT

An elongated forend member is the principal component of the modular system rifle stock. The forend member can be injection molded or milled from an aluminum billet. The forend member has laterally spaced left and right side walls whose bottom edges are connected to a bottom wall to form an elongated chamber that extends substantially the length of the forend member. The elongated chamber can accommodate most of the receivers/actions of existing rifles and shotguns. The rear wall of the forend member has a protruding boss member or specifically shaped recess that allows either a slider or firearm stock to be secured thereto.

13 Claims, 3 Drawing Sheets

MODULAR SYSTEM RIFLE STOCK

This patent application claims priority of U.S. Provisional Patent Application 60/771,934 filed Feb. 9, 2006.

BACKGROUND OF THE INVENTION

The invention relates to firearms such as rifles and shotguns. More specifically, the novel structure is a forend member that can compatibly receive different types of receivers or actions. Presently conventional individual rifle stocks are peculiar to their own individual actions. These rifle stocks only fit the shape of that particular action.

The firearm receiver is also known as an action. A few of the different types of actions would be Hawa-Weatherby type action, the 50 caliber Barrett action, a Winchester action, a Remington 700 action, etc. These different kinds of actions can be purchased separately from the specific individual stock that is normally required for that specific action.

It is an object of the invention to provide a novel elongated forend member that can be assembled with any one of a multitude of existing firearm actions.

It is also an object of the invention to provide a novel elongated forend member that can have anyone of many different types of sliders and butt stocks assembled to the rear of the forend member.

It is another object of the invention to provide a novel elongated forend member that can be injection molded or milled from a metal billet such as aluminum.

It is an additional object of the invention to provide a novel elongated forend member having a distinct modern appearance.

SUMMARY OF THE INVENTION

The principal component of the modular system rifle stock is an elongated forend member. It has a pair of laterally spaced sidewalls whose bottom ends are connected to the bottom wall to form an elongated chamber that extends substantially the length of the forend member. The front end of the forend member is normally positioned below the gun barrel. The rear end of the forend extends slightly beyond the rear end of the firearm action. The forend member has a pair of vertical apertures that receive the screws that are secured to the action and/or gun barrel. The forend member is configured so that it can receive one of many existing actions that are on the market.

The rear end of the forend member has a boss member extending rearwardly therefrom. There is a threaded bore in the boss member. If the forend member has been formed from a billet, the boss is an integral piece of the billet member. If the forend member has been injected molded, the boss member would have been inserted into the mold so that it is formed integrally with the rear wall of the forend member.

The boss member could have any desired peripheral configuration, but a preferred configuration is a boss member having four sides shaped like a square. A slider or wooden stock or other type of stock could be secured directly to the rear end of the forend member by a bolt. The slider or front end of the stock would have a mating interlocking recess for receiving the boss member.

It is to be understood that instead of having a protruding body member, a recess could be formed in the rear wall of the forend member and then the slider or front end of a stock to be assembled thereto would have a protrusion of a mating configuration.

In an embodiment where a slider is secured to the rear of the forend, a pistol grip having a recoil system therein similar to that illustrated U.S. Pat. No. 5,722,195 could be used. Also a recoil system, such as manufactured by Knoxx Industries, may be incorporated into the structure of the adjustable length of the stock.

No one has made a stock that fits all types of rifles including rifles having different actions. No one has made a one piece forend member or rifle forend to fit different kinds of actions. No one has made a detachable butt portion of a stock that can be assembled to and disassembled from one action to another. The present stocks on the market are all peculiar to the particular type of action for which it has been manufactured.

A person can buy individual actions and have a rifle forend custom made for that particular action. Then they can purchase one or more different butt stocks or adjustable butt stocks that can be interchanged with the actions they have purchased. It is therefore not necessary to purchase a separate butt stock for each rifle or shotgun.

DESCRIPTION OF THE PREFERRED EMBODIMENT

Figure 1:
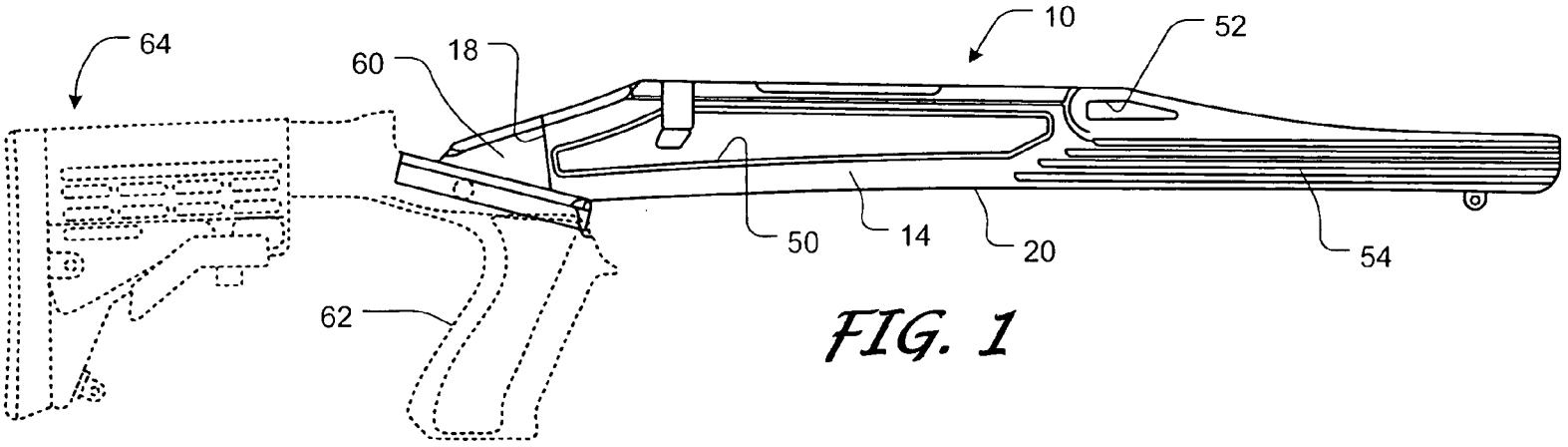
FIG. 1 is a right side elevation view of the novel forend member showing the slider connected thereto.

The novel forend member will now be described by referring to FIGS. 1-8 of the drawings. Forend member 10 has a left side wall 12, a right side wall 14, a front wall 16, a rear wall 18 and a bottom wall 20. These respective walls form an elongated chamber 22 that extends substantially the length of the forend member. There is a major shell housing opening 24 and a trigger mechanism opening 26 formed in bottom wall 20. Bottom wall 20 has a plurality of columns of apertures 30 longitudinally spaced from each other along the length of the bottom wall 20. The top surface of bottom wall 20 has a longitudinally extending stiffener 32. A nut 34 is secured to the top end of a bolt 36 extending downwardly from bottom wall 20 that is utilized for holding the front end of a sling. Screw apertures 40 and 42 receive screws that are used to attach the action and/or gun barrel. Front wall 16 has a pair of air ventilation apertures 44. The outer surface of the side walls have a longitudinally extending major decorative or stylish recess 50. Minor decorative or stylish apertures 52 are also found in the respective side walls. The front end of each of the side walls have a stack of fin members 54 extending outwardly therefrom.

Figure 2:
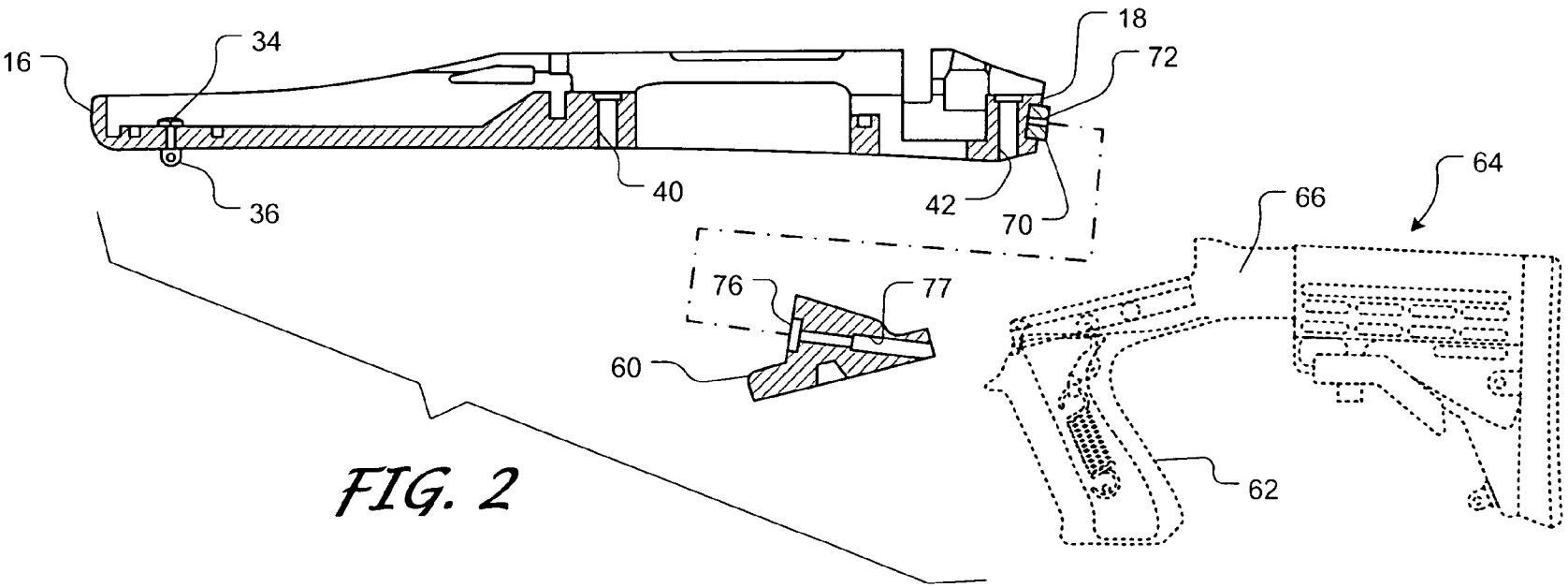
FIG. 2 is an exploded vertical cross section of the novel forend member that is connected to the slider.
Figure 3:
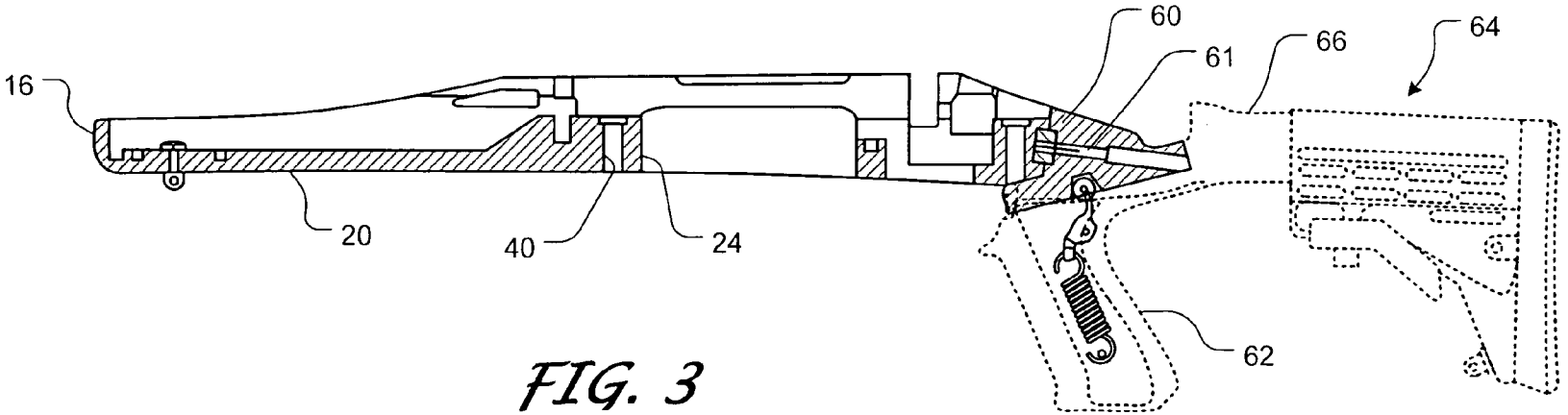
FIG. 3 is an assembled vertical cross section view of the novel forend member attached to the slider.

In FIGS. 1 and 2, forend member 10 is shown connected to a slider 60 that would be mounted in the top end of a handgrip 62. An adjustable length stock 64 would be telescoped over tubular member 66 extending from the rear end of handgrip 62. FIG. 2 shows the boss member 70 protruding from rear wall 18. In a preferred embodiment, boss member 70 would have a square peripheral configuration. It would have been integrally formed in a metal forend member and/or inserted into the mold if the forend member were injection molded. Boss member 70 would have a threaded bore 72. Slider 60 is shown to have a recess 76 formed in its front end that would mate with boss member 70. A bore hole 77 passes from the rear end of slider 60 to recess 76. A bolt would be passed through this bore hole to secure the slider 60 to the rear end of forend 10. Handgrip 62 is shown to have recoil reduction structure therein, FIG. 3 is a vertical cross sectional view showing the slider 60 secured to the rear end of forend 10 by a bolt 61.

Figure 4:
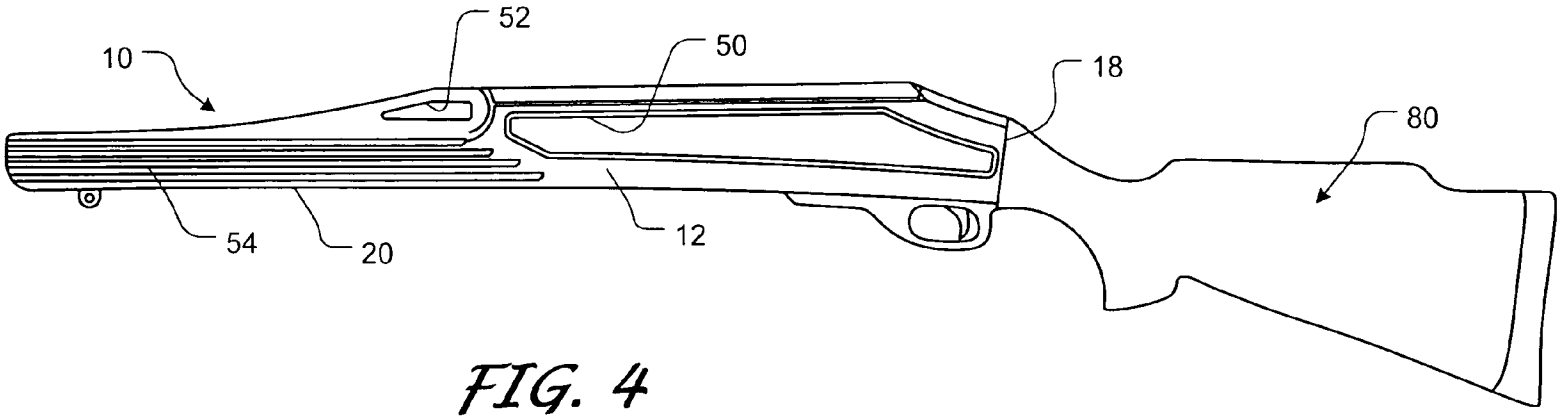
FIG. 4 is a left side elevation view of the novel forend member showing a wooden stock attached to its rear end.
Figure 5:
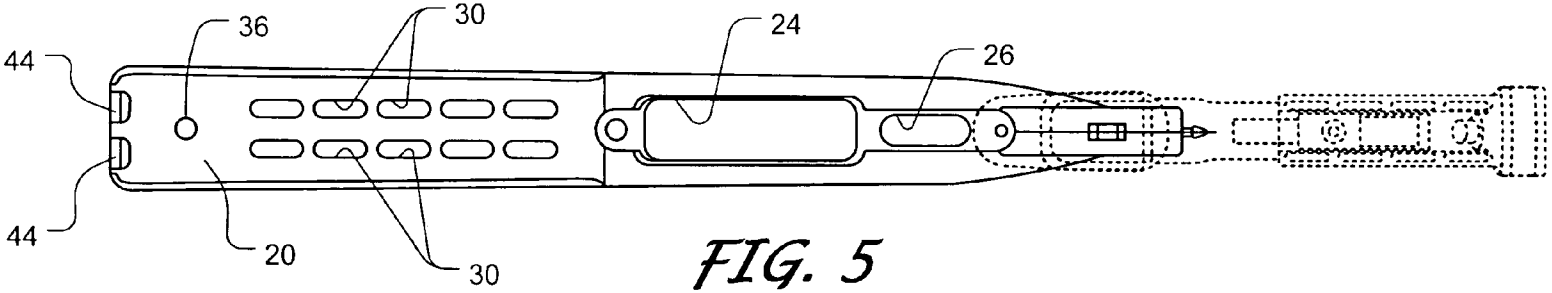
FIG. 5 is a bottom plan view of the novel forend member.
Figure 6:
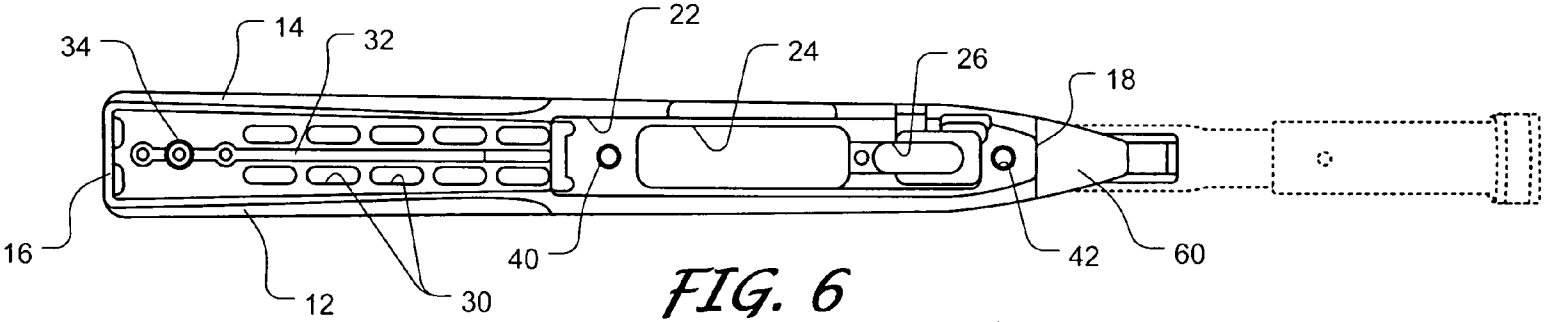
FIG. 6 is a top plan view of the novel forend member.
Figure 8:
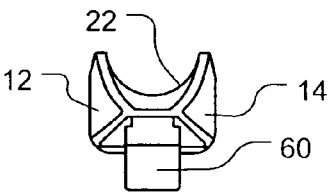
FIG. 8 is a rear elevation view of the novel forend member with the slider attached thereto.
Figure 7:
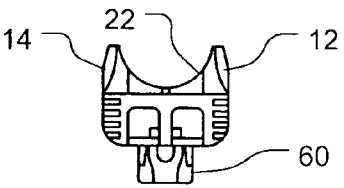
FIG. 7 is a front elevation view of the novel forend member showing the slider attached thereto.

FIG. 4 shows an example of forend member 10 secured to the front end of a wooden stock 80. Wooden stock 80 would have a recess formed in its front end to mate with boss member 70.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and the number and configuration of various components described above may be altered, all without departing from the spirit or scope of the invention as defined in the appended Claims.

What is claimed:

1. A modular system rifle stock comprising:

an elongated forend member having a laterally spaced left and right side walls, said left side wall having a top edge and a bottom edge, said right side wall having a top edge and a bottom edge;

a bottom wall connects the respective bottom edges of said left and fight side walls to form an elongated chamber that extends substantially the length of said forend, said forend having a front end and a rear end;

said front end having a front wall having an outer surface and an inner surface;

said rear end having a rear wall having an outer surface and an inner surface, wherein said rear wall is configured to mate, via a slider member, to a removable stock, wherein said slider member is part of a recoil reduction structure and is slidably mountable to the removable stock such that the slider member remains slidable relative to the removable stock when mounted to the removable stock, and wherein said rear wall of said forend member has a rearwardly projecting boss member with an internally threaded bore for receiving a bolt that would fasten said slider member thereto;

support means in said chamber for connection to an action for a firearm;

a first opening in said bottom wall through which ammunition for said firearm can be fed to said action; and a second opening in said bottom wall, wherein said second opening is for a trigger of said action.

2. A modular system rifle stock as recited in claim 1 wherein said elongated forend has been formed from a metal billet.

3. A modular system rifle stock as recited in claim 2 wherein said metal is aluminum.

4. A modular system rifle stock as recited in claim 1 wherein said elongated forend has been injection molded from a plastic material.

5. A modular system rifle stock as recited in claim 1 wherein said bottom wall of said forend has a plurality of columns of apertures; said apertures being longitudinally spaced from each other along the length of said bottom wall.

6. A modular system rifle stock as recited in claim 1 wherein said left and right side walls each have an outer surface having a longitudinally extending decorative recess.

7. A modular system rifle stock as recited in claim 6 further comprising vertically stacked longitudinally extending fins in said respective outer surfaces of said left and fight side walls.

8. A modular system rifle stock as recited in claim 1 wherein said left and right side walls each have a longitudinally extending decorative aperture.

9. A modular system rifle stock as recited in claim 1 wherein the perimeter shape of said boss member is four sided.

10. A modular system rifle stock as recited in claim 1 wherein said boss member is integrally formed in said rear wall of said forend member.

11. A modular system rifle stock as recited in claim 1 further comprising a firearm stock connected to said rear wall of said forend member.

12. A modular system rifle stock as recited in claim 1 wherein said slider member is formed as an integral portion of said rear wall.

13. A modular system rifle stock as recited in claim 1 wherein said first opening and said second opening are at least partially joined to form a single opening.

* * * * *